US009933229B2

(12) United States Patent
Coalson et al.

(10) Patent No.: US 9,933,229 B2
(45) Date of Patent: Apr. 3, 2018

(54) DROP AWAY ARROW REST

(71) Applicant: TRUGLO, Inc., Richardson, TX (US)

(72) Inventors: Damon Lamont Coalson, Dallas, TX (US); John Estridge, Garland, TX (US)

( * ) Notice: Subject to any disclaimer, the term of this patent is extended or adjusted under 35 U.S.C. 154(b) by 0 days.

(21) Appl. No.: 15/685,144

(22) Filed: Aug. 24, 2017

(65) Prior Publication Data

US 2018/0058798 A1 Mar. 1, 2018

Related U.S. Application Data

(60) Provisional application No. 62/378,718, filed on Aug. 24, 2016.

(51) Int. Cl.

| | |
|---|---|
| ***F41B 5/22*** | (2006.01) |
| ***F41B 5/14*** | (2006.01) |
| *F41B 5/10* | (2006.01) |

(52) U.S. Cl.

CPC ..... *F41B 5/143* (2013.01); *F41B 5/10* (2013.01)

(58) Field of Classification Search

CPC ..... F41B 5/143

See application file for complete search history.

(56) References Cited

U.S. PATENT DOCUMENTS

| | | | | |
|---|---|---|---|---|
| 4,287,868 | A * | 9/1981 | Schiff | F41B 5/143 124/24.1 |
| 6,789,536 | B1 * | 9/2004 | Summers | F41B 5/143 124/44.5 |
| 7,409,950 | B2 * | 8/2008 | Ellig | F41B 5/143 124/44.5 |
| 7,597,095 | B2 * | 10/2009 | Grace, Jr. | F41B 5/143 124/44.5 |
| 8,434,464 | B1 * | 5/2013 | Terzo | F41B 5/143 124/44.5 |
| 9,182,190 | B2 * | 11/2015 | Khoshnood | F41B 5/1403 |
| 9,341,433 | B1 * | 5/2016 | Summers | F41B 5/143 |
| 9,726,453 | B1 * | 8/2017 | Hamm | F41B 5/143 |

* cited by examiner

*Primary Examiner* — John Ricci

(74) *Attorney, Agent, or Firm* — Bennet K. Langlotz; Langlotz Patent & Trademark Works, Inc.

(57) ABSTRACT

A drop away arrow rests which prevents movement of the rest element during the drawing, firing or let down of an archery bow. A drop away arrow rest that provides an optimized delay function for the dropping of the rest element after release of the bow string when firing the arrow to provide maximum support for the arrow during the launch with a last second, high speed dropping motion to clear the vanes on the arrow.

40 Claims, 13 Drawing Sheets

DROP AWAY ARROW REST

CROSS-REFERENCE TO RELATED APPLICATION

This application claims the benefit of U.S. Provisional Patent Application No. 62/378,718 filed on Aug. 24, 2016, entitled "Click Up Archery Rest", which is hereby incorporated by reference in its entirety for all that is taught and disclosed therein.

FIELD OF THE INVENTION

The present invention relates to arrow rests for archery bows. More specifically, the present invention relates to drop away arrow rests for archery bows.

BACKGROUND OF THE INVENTION

The use of fall away arrow rests is well known in the field of archery. More specifically, arrow rests previously devised and utilized for the purpose of falling away to preclude drag are known to consist basically of familiar, expected, and obvious structural configurations. While these devices fulfill their respective particular objectives, the devices do not provide drop away arrow rests that prevent movement of the launcher during the drawing, firing or let down of an archery bow. They also do not provide a delay function for the dropping of the launcher after release of the bow string when firing the arrow.

Therefore, there is a continuing need for a new and improved drop away arrow rest which can be used to prevent movement of the launcher during the drawing, firing or let down of an archery bow. It is also beneficial to have an optimized delayed dropping of the launcher after release of the bow string to provide maximum support for the arrow during the launch with a last second, high speed dropping motion to clear the vanes on the arrow.

SUMMARY OF THE INVENTION

The present invention provides a drop away arrow rest, adapted to be mounted on an archery bow and support an arrow. The drop away arrow rest includes a main housing, the main housing adapted to be mounted to the archery bow; a support assembly mounted as part of the main housing; a rest element adapted to support the arrow in a support position, the rest element attached to the support assembly such that the rest element is moved by the support assembly; a spring biasing the rest element; a lock assembly attached to the support assembly to lock the rest element in the support position; a lock to capture the lock assembly and lock the rest element in the support position; an actuator to engage the lock assembly by dislodging the lock assembly from the lock and allow movement of the rest element to the release position; and a cord attached to the actuator to activate the actuator to dislodge the lock assembly, the cord adapted to be connected to a moving element of the archery bow such that the cord moves when the moving element moves, the cord connected such that when the moving element moves during firing of the arrow, the actuator dislodges the lock assembly from the lock due to release of tension on the cord.

DESCRIPTION OF THE CURRENT EMBODIMENT

Figure 1:
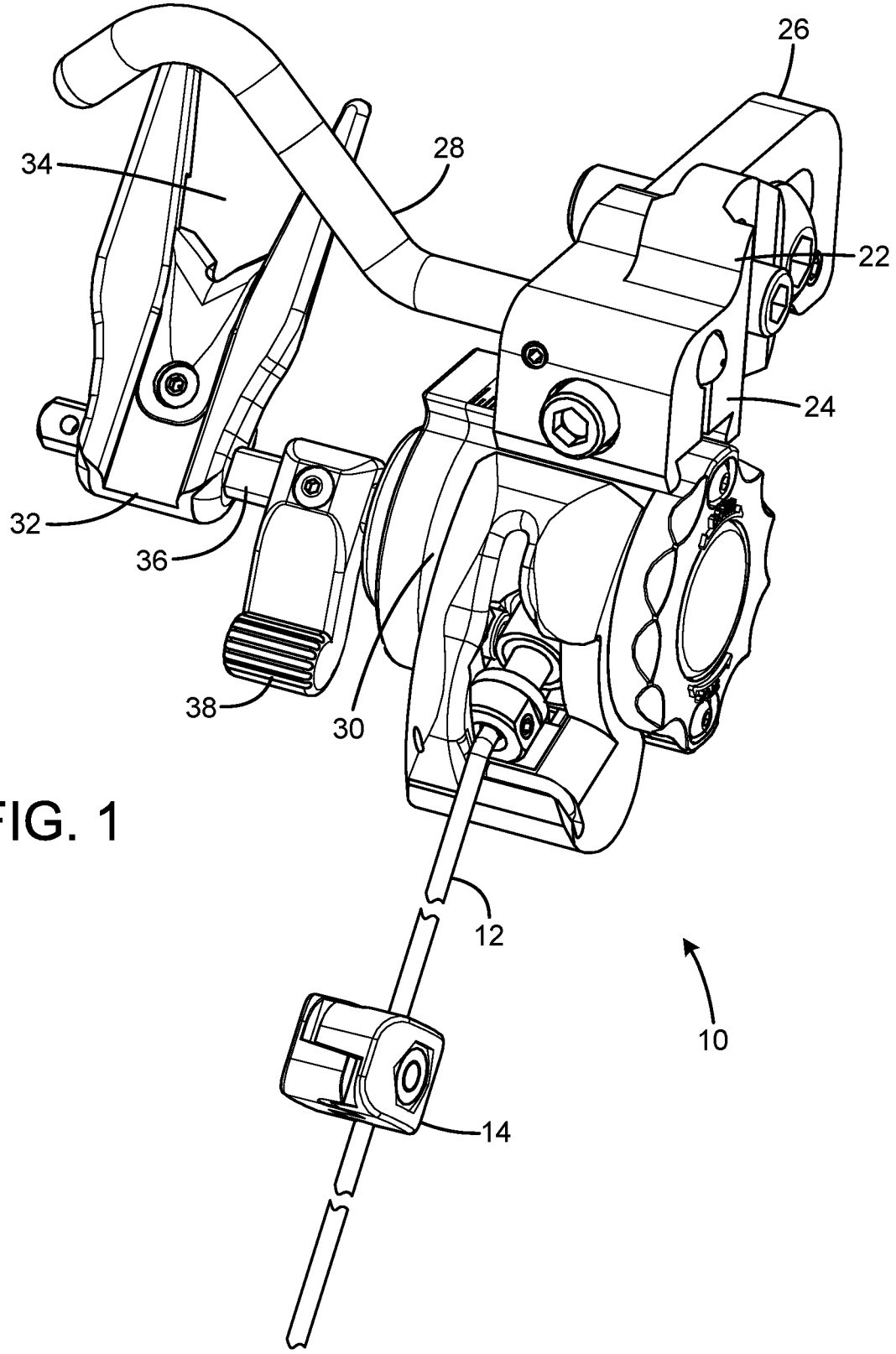
FIG. 1 is a perspective view of a drop away arrow rest in a support position according to the present invention.
Figure 2:
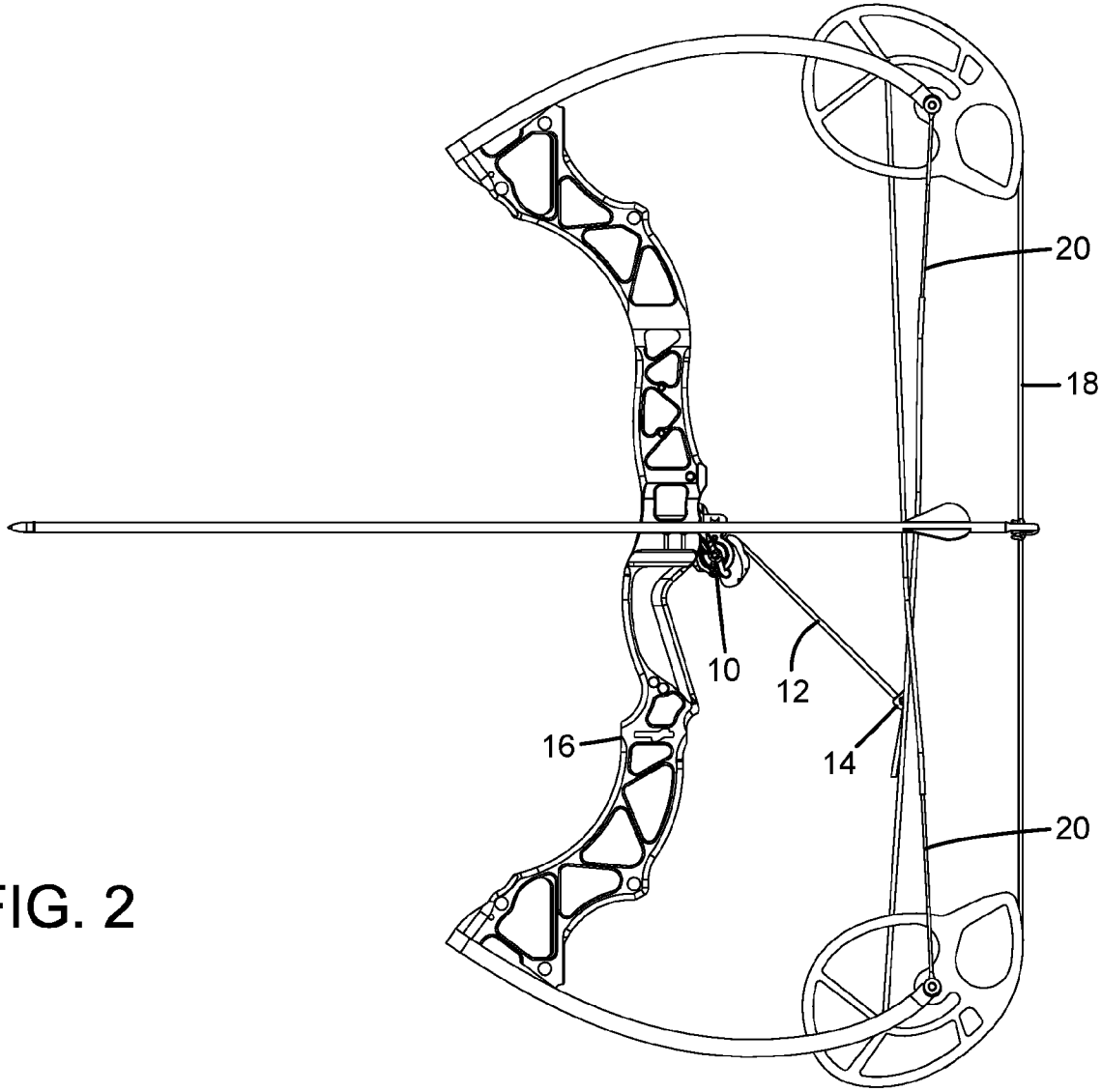
FIG. 2 is a side view of a drop away arrow rest on an archery bow according to the present invention.
Figure 3:
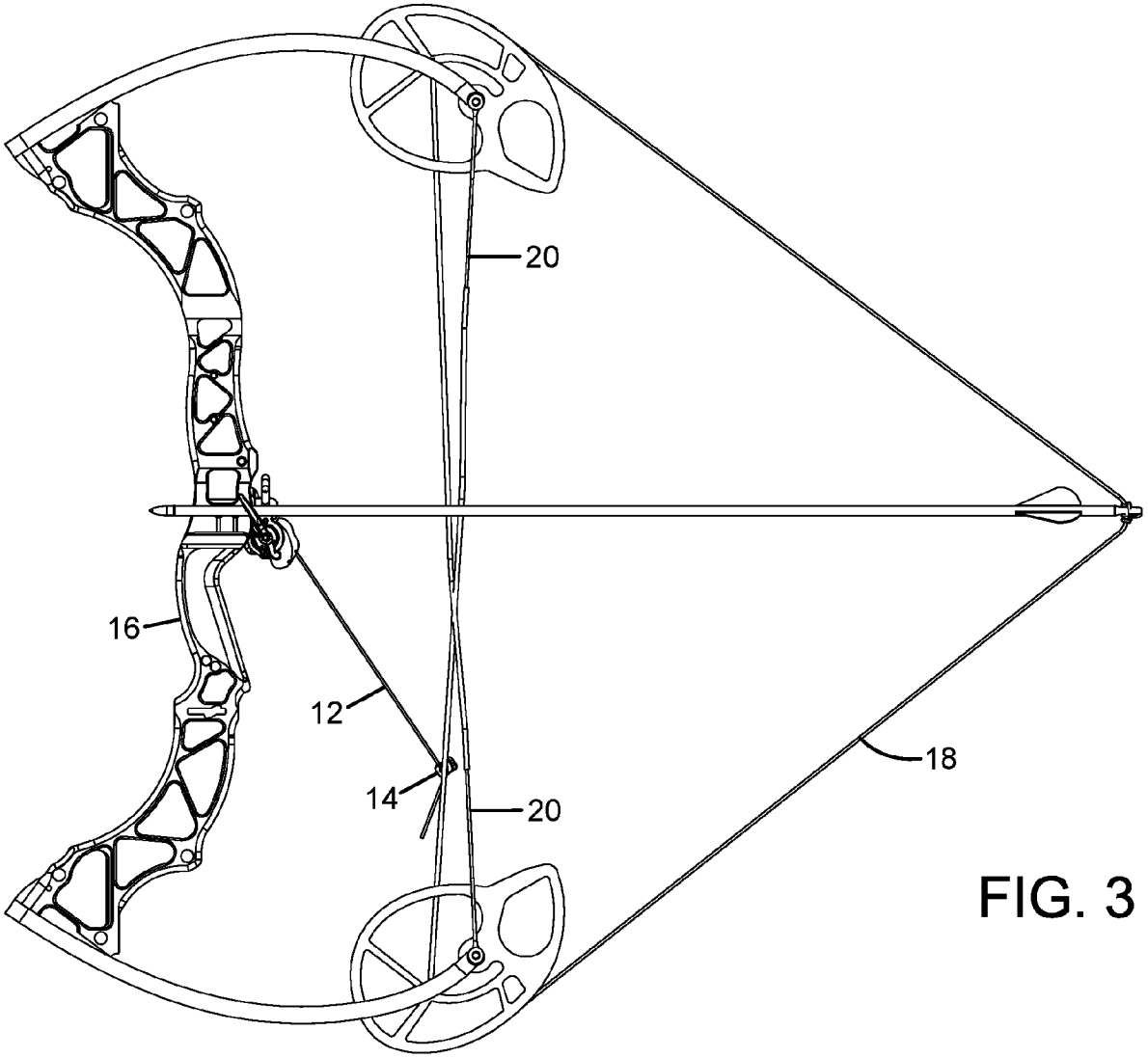
FIG. 3 is a side view of a drop away arrow rest on an archery bow at full draw according to the present invention.

FIG. 1 shows a drop away arrow rest 10 for mounting to an archery bow. The drop away arrow rest includes a cord 12 and cable mount 14 attached to the cord 12. FIG. 2 shows the drop away rest 10 mounted to a modern archery bow 16 with the bow string 18 in an undrawn position. Modern archery bows typically employ cam cables 20 to reduce pulling effort by the user. The cable mount 14 is attached to the downward moving cam cable 20. The cam cables 20 are an example of a moving element of the archery bow. Other examples of a moving element on an archery bow are bow limbs, bow string and cams and there can be others. FIG. 3 shows the cord 14 being drawn away from the drop away rest 10 when the bow string 18 is drawn due to movement of the cam cables 20.

Figure 4:
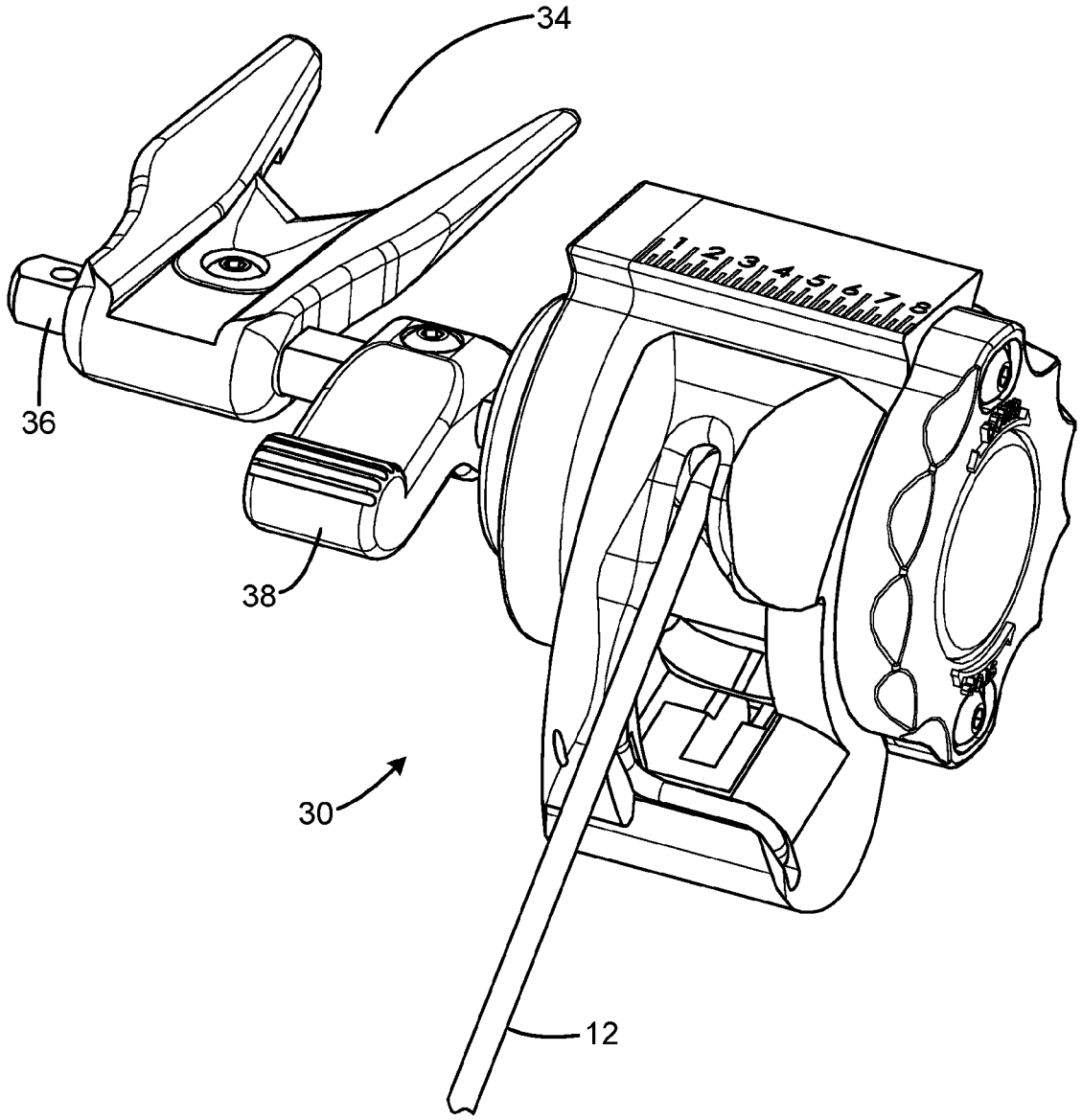
FIG. 4 is a perspective view of a drop away arrow rest in a release position according to the present invention.
Figure 5:
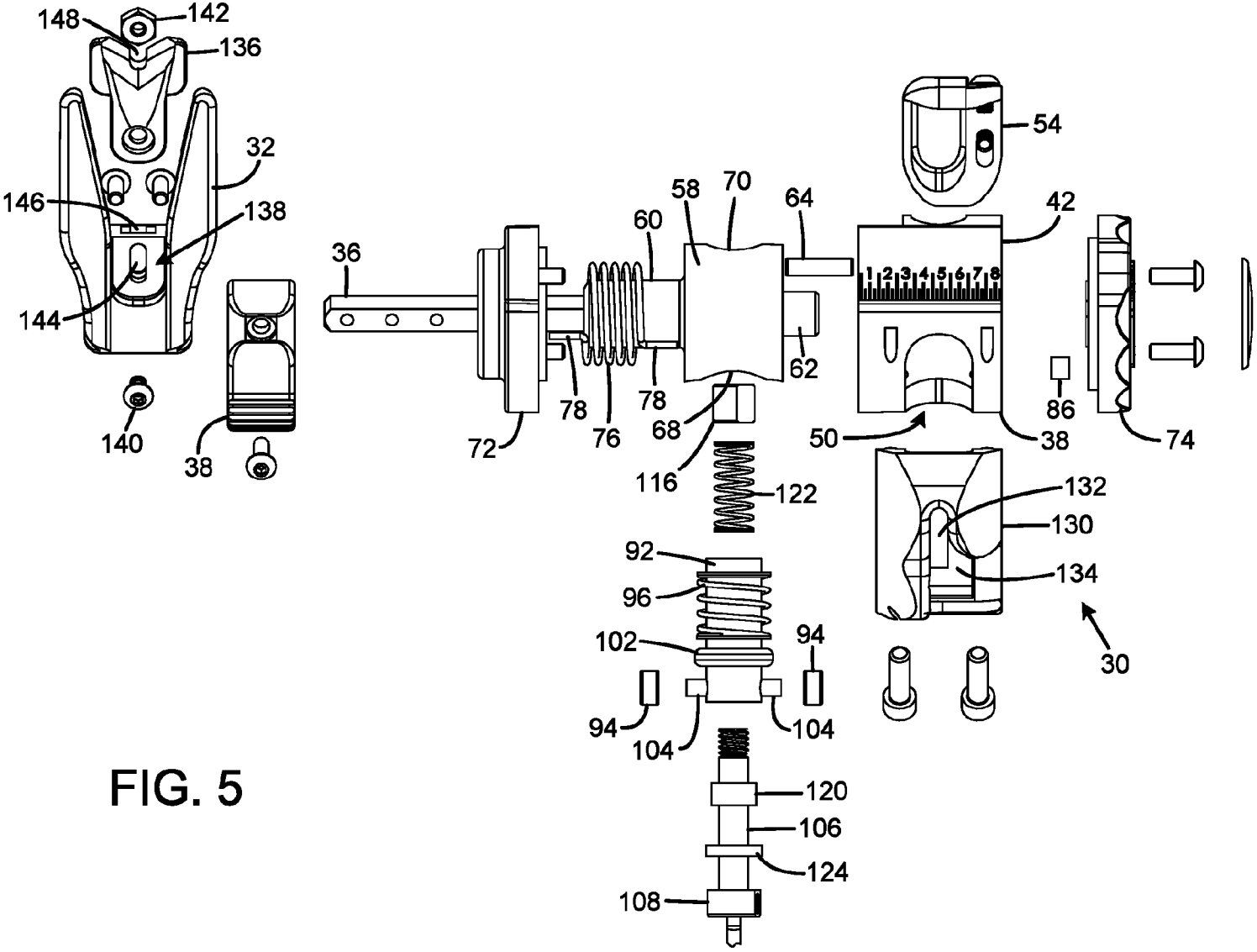
FIG. 5 is a top exploded view of a drop away arrow rest according to the present invention.
Figure 6:
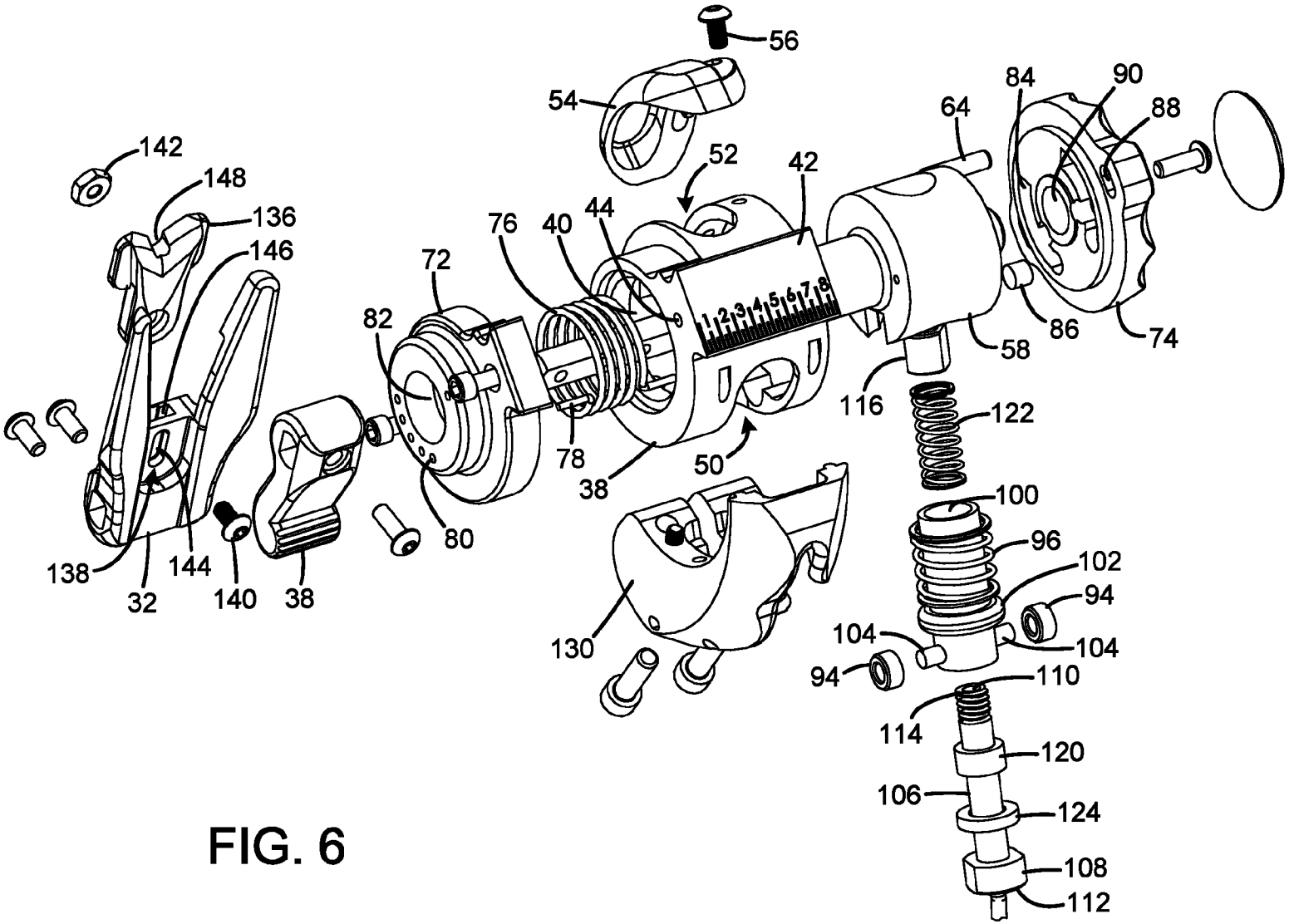
FIG. 6 is a perspective exploded view of a drop away arrow rest according to the present invention.

A mount assembly 22 used for mounting the drop away arrow rest 10 to the archery bow 16 is shown in FIG. 1. The mount assembly 22 includes a rail receiver 24, riser mount 26 and capture bar 28. The rail receiver 24 attaches to a launcher control assembly 30. The riser mount 26 attaches to the archery bow 16. The capture bar 28 prevents the arrow from falling off the launcher arm in the event the bow is tilted at an extreme angle. FIG. 4 shows the mount assembly 22 removed from the launcher control assembly 30. FIGS. 5-6 show exploded views of the launcher control assembly 30 of FIG. 4. A launcher 32 that is a rest element for supporting the arrow is shown in FIGS. 4-6. The launcher 32 includes an arrow slot 34 for holding the arrow at rest prior to firing of the arrow. The launcher 32 is attached to a launcher arm 36 which extends from the launcher control assembly 30. A thumb lever 38 is mounted on the launcher arm 36 between the launcher 32 and the launcher control assembly 30.

Figure 7:
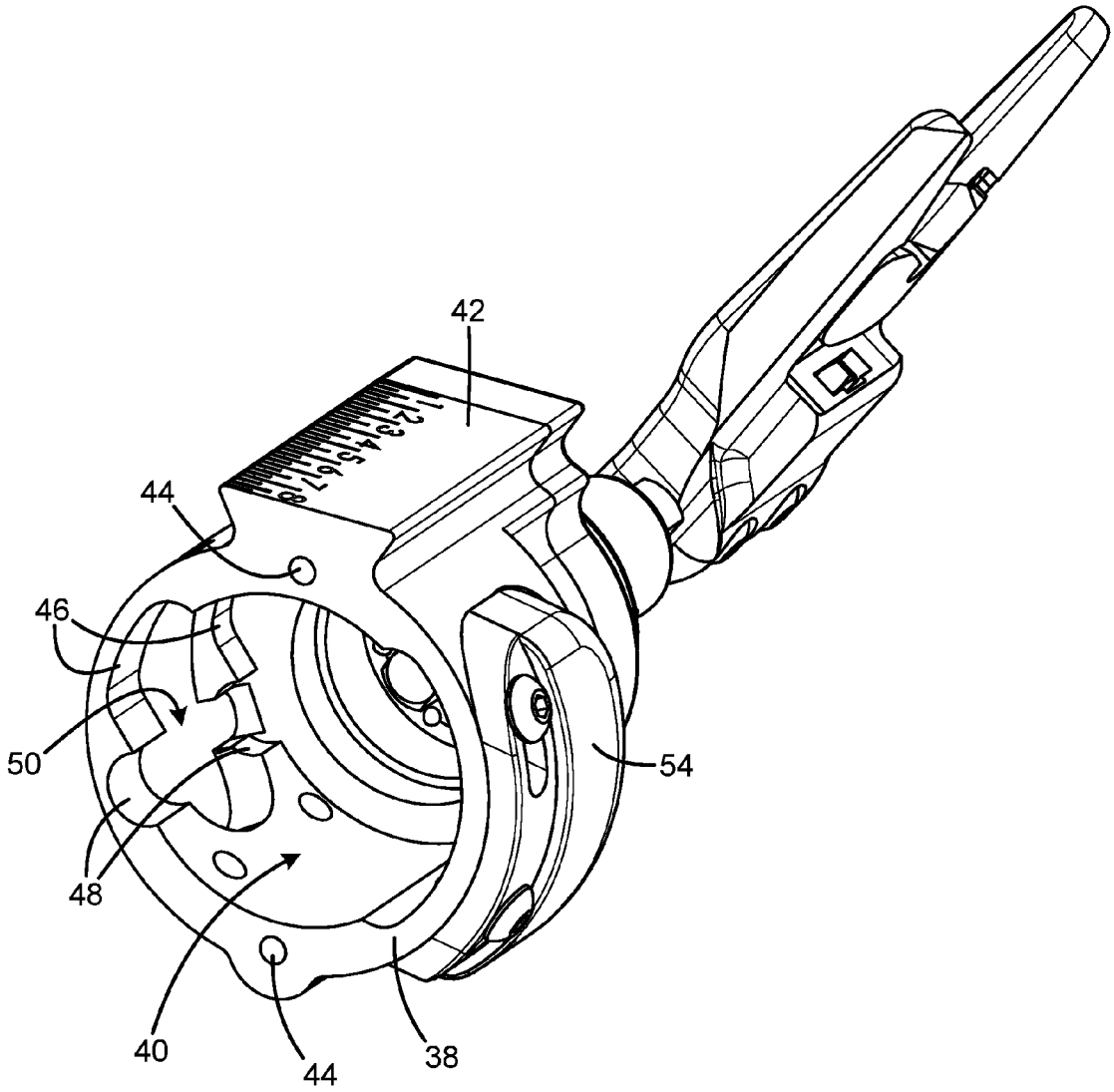
FIG. 7 is a perspective view of a drop away arrow rest according to the present invention.
Figure 8:
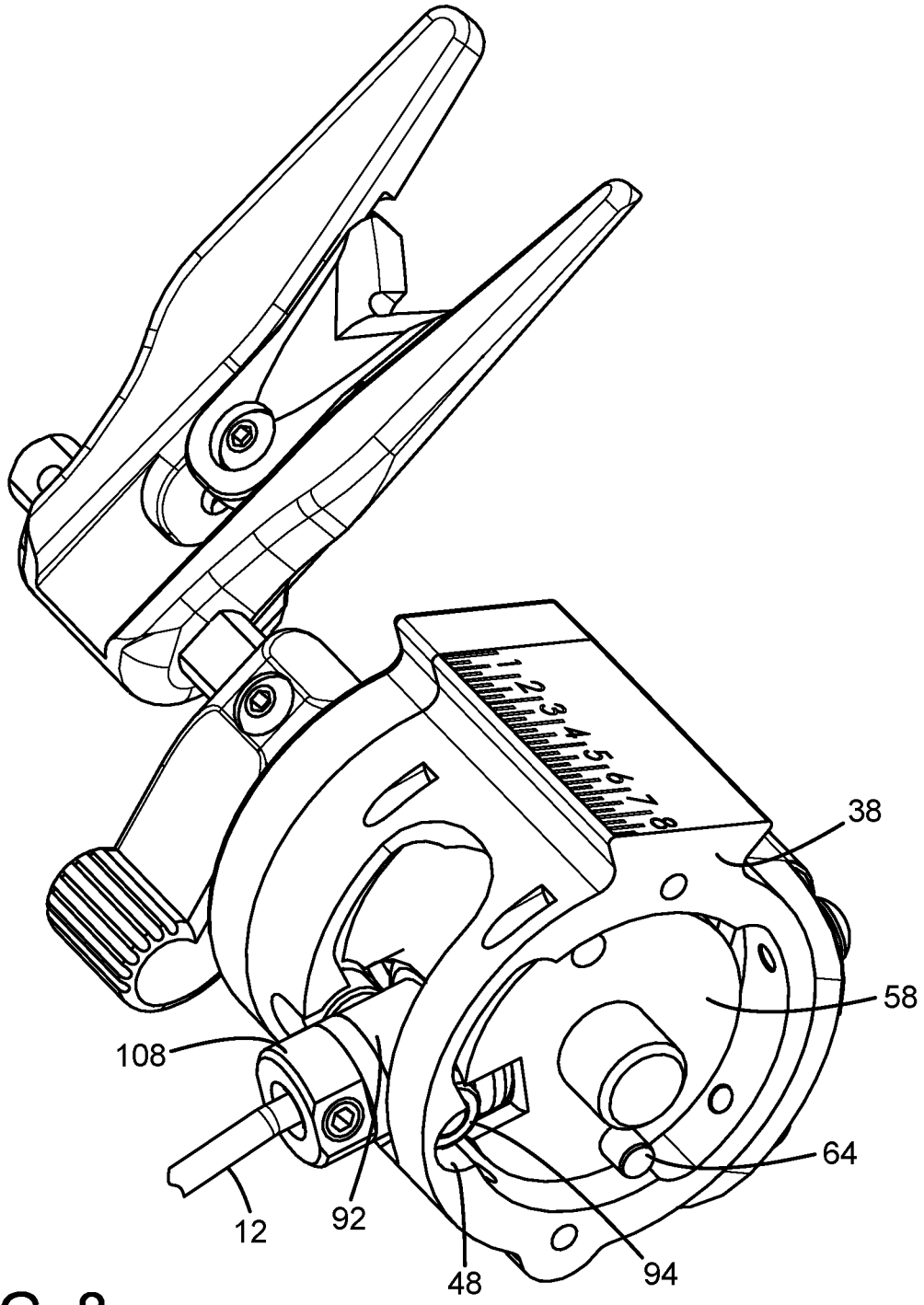
FIG. 8 is a perspective view of a drop away arrow rest according to the present invention.

FIGS. 5-8 show a main housing 38 of the launcher control assembly 30. The main housing 38 incudes a component cavity 40 and a mounting rail 42 to receive the mount assembly 22. The main housing 38 includes open sides to the component cavity 40 with external screw holes 44. The component cavity 40 includes an inside roller path 46 to a detent 48 and outside roller path 46 to a detent 48, as shown in FIGS. 7-8. The main housing 38 includes a hammer access 50 to the component cavity 40. The main housing 38 includes an access hole 52 to the component cavity 40 and an access cover 54 that secures to the main housing 38 using screw 56.

Figure 10:
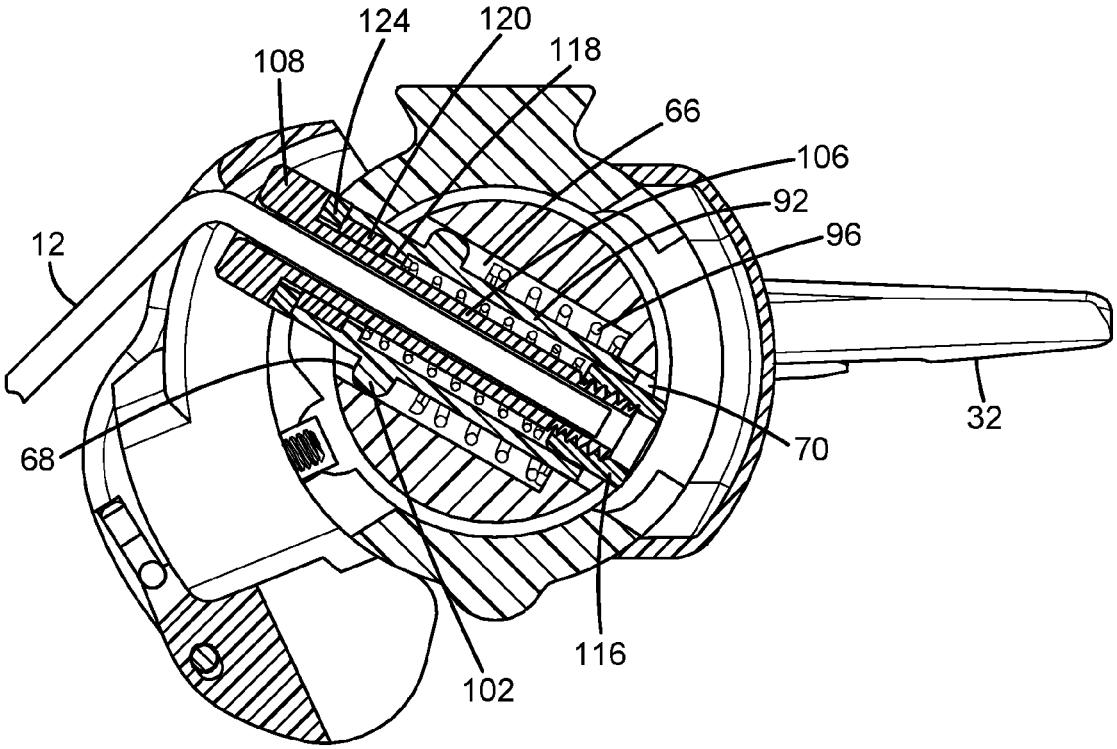
FIG. 10 is a side cross sectional view of a drop away arrow rest according to the present invention.

A rotor 58 is shown in FIGS. 5-6 and 8 that mounts inside component cavity 40 of the main housing 38, such that the rotor 58 can rotate within the main housing 38. The rotor 58 is a cylinder shaped body having an arm receiver 60 extending from one side and a bearing cylinder 62 extending from the other side. The rotor is a support assembly for the launcher arm 36. The arm receiver 60 includes an arm cavity shaped to receive the shape of the launcher arm 36. The launcher arm 36 mounts inside the component cavity and rotates with the rotation of the rotor 58 in the main housing 38, where the launcher arm 36 defines the axis of rotation of the launcher 32. The outside surface of the arm receiver 60 and the outside surface of the bearing cylinder 62 both act as bearing surfaces for the rotor 58 to rotate upon. The rotor 58 includes a guide pin 64 extending from the rotor 58. The rotor 58 includes a hammer assembly cavity 66, as shown in FIG. 10. The hammer cavity 66 having a larger opening 68 and a smaller opening 70.

The launcher control assembly 30 includes a fixed end cap 72 and an adjustable end cap 74 to close off the open sides of the main housing 38. The fixed end cap 72 screws to the open side near the launcher 32. The fixed end cap 72 includes a rotor spring 76 mounted to the inside of the fixed end cap 72 using a spring leg 78 in one of the spring leg holes 80 in the fixed end cap 72. Having more than one spring leg hole 80 allows for spring tension adjustment. The rotor spring 76 includes a second spring leg 78 that attaches to the rotor 58 to bias the rotor 58 to rotate towards dropping the launcher 32. The fixed end cap 72 includes a cap hole 82 with a bearing surface to receive the outside surface of the arm receiver 60. The adjustable end cap 74 incudes a guide pin groove 84 to receive the guide pin 64 of the rotor 58 and a rubber bumper 86 that fits into one end of the guide pin groove 84. The bumper 86 deadens the shock to the drop away rest 10 when the launcher 32 is released from holding the arrow and the guide pin 64 hits the bumper 86. The adjustable end cap 74 includes slotted screw holes 88. When the adjustable end cap 74 is attached, the guide pin 64 is against the bumper 86 and sets the starting position of the launcher 32, by setting the positon of the rotor 58. The slotted screw holes 88 allow for a five degree adjustment of securing the adjustable end cap 74 to the main housing 38. The five degree adjustment translates to a five degree adjustment of the rotor 58 and the launcher 32. The adjustable end cap 74 includes a cap hole 90 with a bearing surface to receive the outside surface of the bearing cylinder 62.

A hammer assembly is shown in FIGS. 5-6 and 8-12 and functions as an actuator assembly. The hammer assembly includes a detent assembly, hammer, hammer spring, cord and cord guide. The detent assembly includes detent body 92, rollers 94 and detent spring 96. The detent assembly is a lock assembly that can be locked into place. The detent body 92 includes a hammer channel 100, collar 102 and roller axles 104. The detent body 92 installs into the larger opening 68 of the hammer assembly cavity 66 with the detent spring 96 installed over the detent body 92. The detent spring 96 is large enough that the detent spring 96 cannot pass through the smaller opening 70 of the hammer assembly cavity 66. The detent spring 96 is captured between the inside surface of the hammer assembly cavity 66 and the collar 102 in compression to bias the detent body 92 outward away from the larger opening 68. The rollers 94 attach to the roller axles 104. The detent body 92 rotates with rotor 58 and the rollers 94 ride in the roller paths 46, as shown in FIG. 8. When the rollers 94 roll into the detents 48, the rollers 94 are retained in the detents 48 due to the dent spring 96 biasing detent body 92 toward the detents 48. The rotor 58 and thereby the launcher 32 are locked in the support position until the detent body 92 is moved against the detent spring 96 to release the rollers 94 from the detents 48. The detents 48 act as a lock and can be in other forms other than indented areas along a path. The detents can be anything that can capture and retain or lock the detent assembly in place, for instance, the rollers 94 could be steel and the detents 48 could be magnets hold the rollers 94 magnetically.

Figure 13:
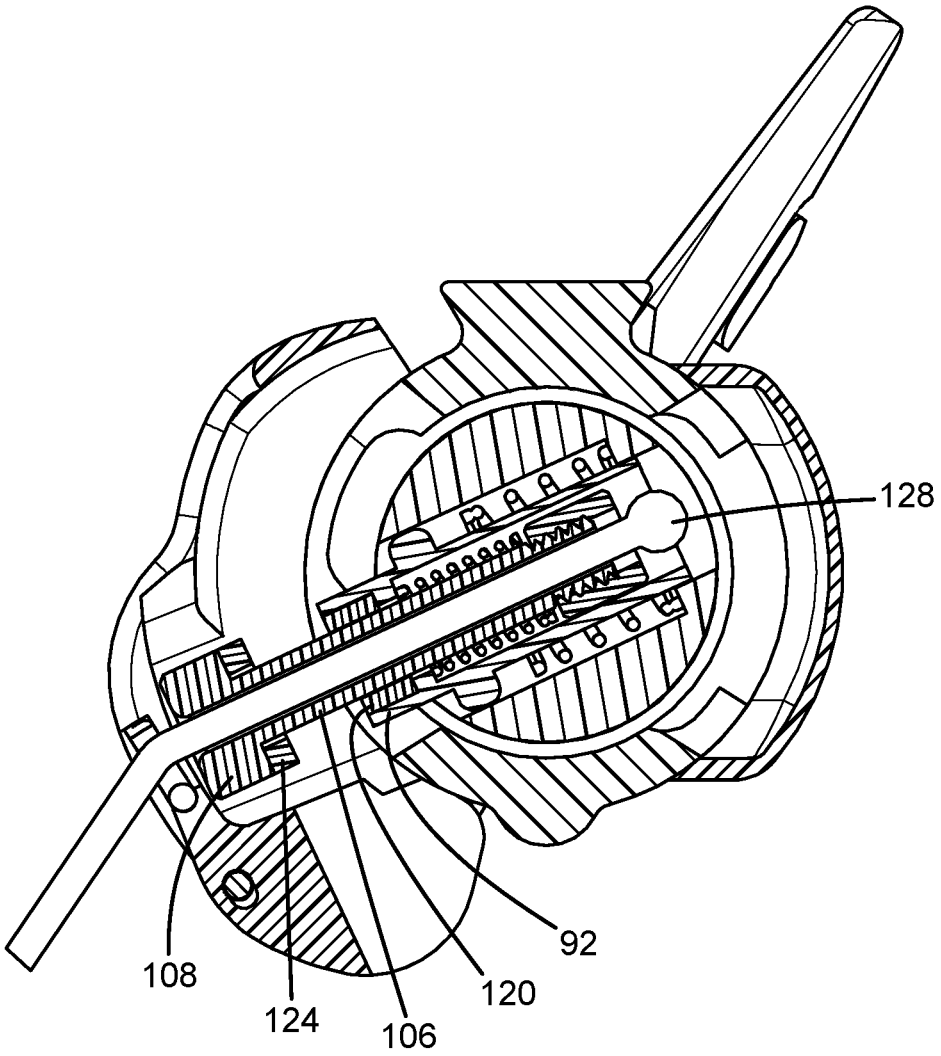
FIG. 13 is a side cross sectional view of a drop away arrow rest according to the present invention.

The hammer, which is an actuator, includes a hammer body 106 and hammer head 108. The hammer body 106 includes a cord channel 110 from top 112 of the hammer head 106 to the bottom 114 of the hammer body 106. The bottom 114 of the hammer body 106 includes threading to receive a nut 116. The hammer channel 100 of the detent body 92 is counter bored from both the top and bottom of the detent body 92, so there is a stop 118 within the hammer channel 100, as shown in FIG. 10. The top of the hammer channel 100 is counter bored to receive a bearing 120 with an open center sized to receive the hammer body 106. The stop 118 restrains the bearing 120. The bottom of the hammer channel 100 is counter bored to receive the hammer spring 122 and the stop 118 restrains the hammer spring 122. The hammer body 106 is installed into the hammer channel 100 by inserting the hammer body 106 into the bearing 120 and through the hammer spring 122. Note, a plastic washer 124 is included on the hammer body 106 to deaden the blow by the hammer head 108. A nut 116 is threaded onto threads at the bottom 114 of the hammer body 106 and against the hammer spring 122 to retain the hammer assembly to the detent body 92. The hammer spring 122 is in compression. The nut 116 fits into counter bore of the detent body 92 so the hammer body 106 can be partially pulled out the top of the detent body 92 against the force of the hammer spring 122. The hammer spring 122 biases the hammer body 106 towards the detent body 92. The nut 116 has an open center so the cord 12 can inserted into the hammer body 106 and out the hammer head 108 along the cord channel 110. The cord 12 includes an end 128 that cannot pass through the nut 116, as shown in FIG. 13. The cord guide 130 of FIGS. 5-6 mounts to the main housing 38 and includes a cord slot 132 and hammer head opening 134. The actuator assembly, actuator, lock assembly and lock can be can be applied to any support assembly that causes movement of the rest element, including for example a support assembly that moves the rest element in a linear fashion.

Figure 9:
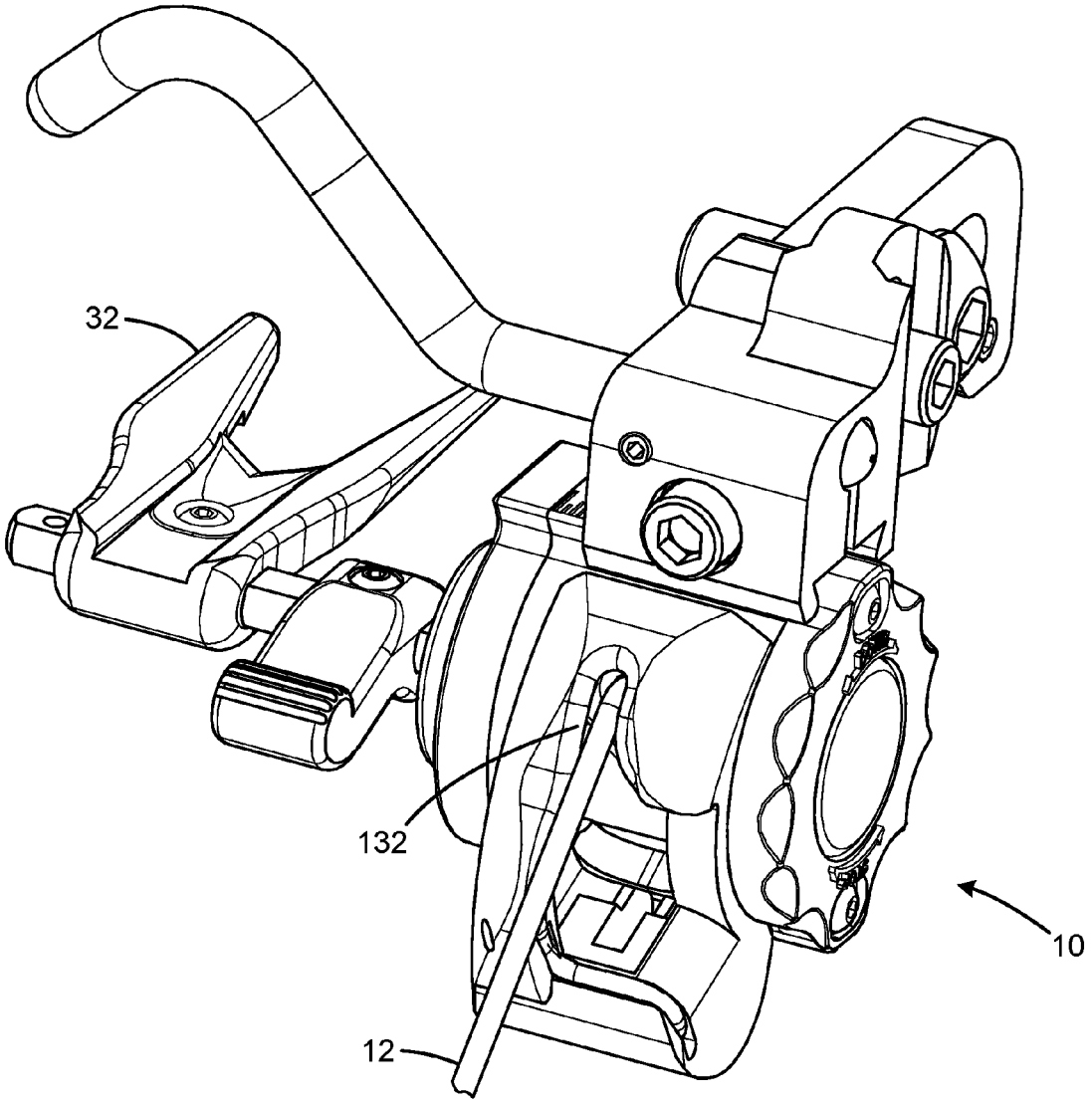
FIG. 9 is a perspective view of a drop away arrow rest according to the present invention.
Figure 11:
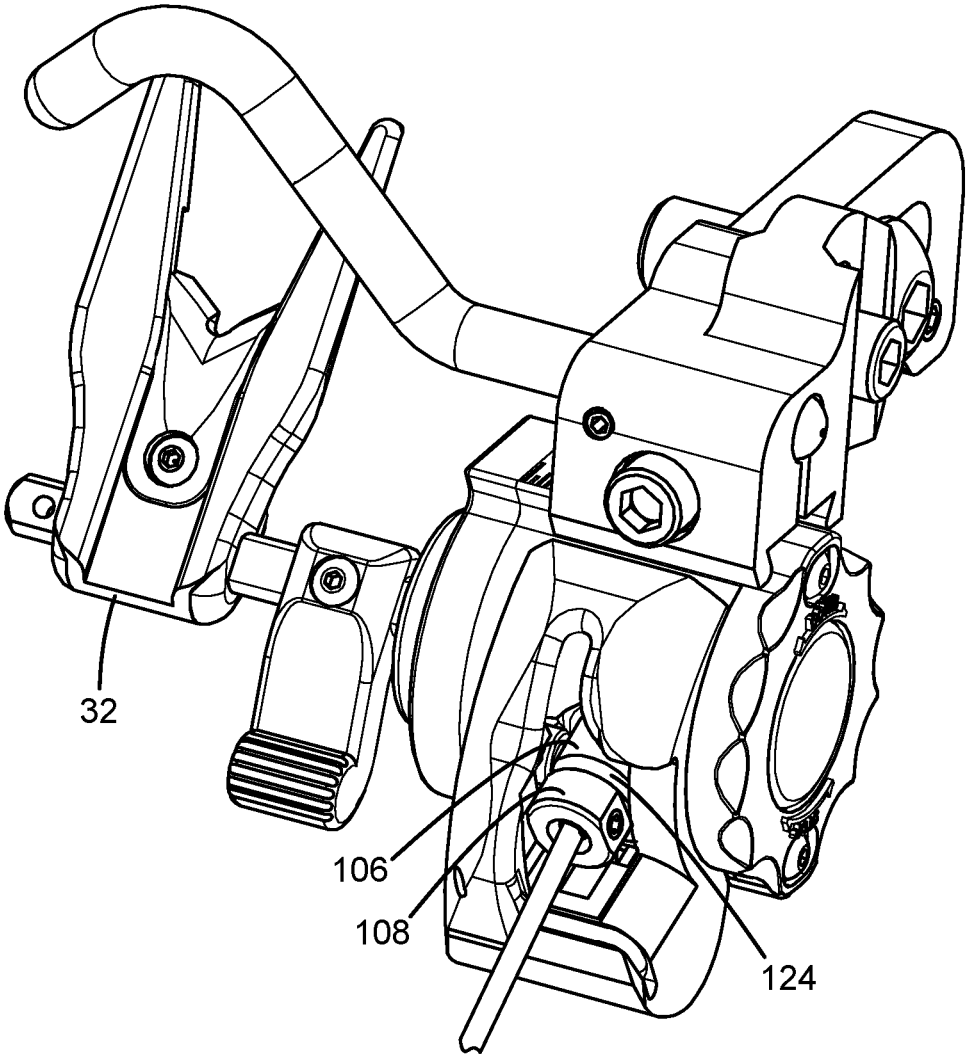
FIG. 11 is a perspective view of a drop away arrow rest according to the present invention.
Figure 12:
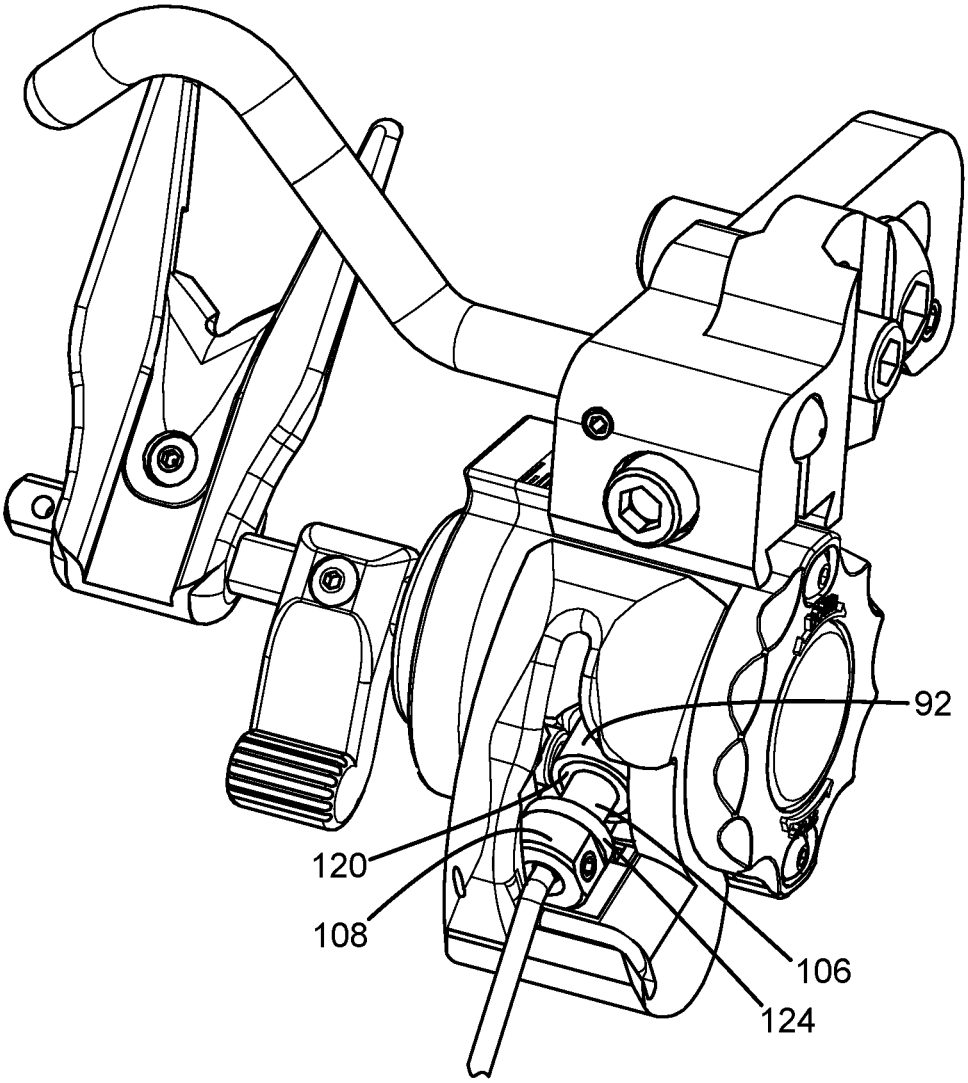
FIG. 12 is a perspective view of a drop away arrow rest according to the present invention.

The drop way arrow rest 10 operation starts with the launcher 32 in the release position, as shown in FIGS. 9-10. When the bow string 18 is drawn, the cam cables 20 pull the cord 12 away from the launcher control assembly 30. When the cord 12 is pulled away and downward along the cord slot 132, the rotor 58 is rotated and the launcher 32 rotates to the support positon to hold the arrow, as shown in FIG. 11. When the rotor 58 rotates, the rollers 94 roll along the roller paths 46 and engage the detents 48, due to the bias of the detent spring 96, whereby the launcher 32 is locked in place in the support position. FIG. 8 shows one of the rollers 94 in the detent 48. When the rotor 58 fully rotates to the locked position, the hammer head 108 is in a position to be pulled out past the hammer head opening 134. Then when the bow string 18 is fully drawn, the hammer head 108 will continue to extend compressing the spring 122 until the hammer head 108 reaches its end limit position as shown in FIGS. 12-13.

When the bow string 18 is released, the hammer head 108 fires back at the detent body 92 due to the bias of the hammer spring 122. The momentum of the hammer head 108 hitting the detent body 92 dislodges the rollers 94 from the detents 48 and releases the rotor 58, as the hammer is a moving mass that transfers momentum to motivate another body by striking it impulsively. Upon release of the rotor 58, the rotor 58 rotates due the bias of the rotor spring 76, thereby rotating the launcher 32 to the release position. There is a delay created between the release of the bow string 18 and the hitting of the detent body 92 by the hammer head 108. The delay is based on the length of the hammer body 106 that is pulled out of the detent body 92 when the bow string 18 is fully drawn. Two other operational features are locking the launcher 32 manually and manual release of the launcher 32. The launcher 32 can be locked in the support position by pushing on the thumb lever 36, whereby the launcher arm 36 is rotated and the rollers 94 are moved into the detents 48. If the bow string 18 is let down without firing an arrow, the launcher 32 can be released by pushing against the hammer head 108 to move the detent body 92 inward to release the rollers 94 from the detents 48. One of the key features is that the launcher 32 does not move once the rotor 58 is in the locked position with the launcher 32 in the support position. So when the launcher 32 is in the support position, drawing of the bow string 18 or letting down of the bow string 18 does not cause the launcher 32 to move, as compared to other drop away rests on the market that have some movement during such changes in bow string 18 operation.

FIGS. 5-6 show an adjustable rest element insert assembly as part of the launcher 32. The adjustable rest element insert assembly allows for the point of contact between the launcher 32 and the arrow shaft to be adjusted if there is not contact or too much contact with the arrow shaft. The adjustable rest element insert assembly includes a rest element insert 136, slotted receiver area 138, screw 140 and nut 142. The slotted receiver area 138 is within the launcher 32 and includes an adjustment slot 144 and a nut receiver slot 146 within the adjustment slot 144. The nut receiver slot 146 receives the nut 142 and locks the nut 142 in position so the nut 142 cannot rotate. The rest element insert 136 includes a V shaped opening 148 to receive the arrow shaft. The rest element insert 136 is placed into slotted receiver area 138 and secured with the screw 140 that is threaded into the nut 142. The adjustment slot 144 allows the rest element insert 136 to be moved up and down along the adjustment slot 144 before the rest element insert 136 is secured in the slotted receiver area 138.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

We claim:

1. A drop away arrow rest, adapted to be mounted on an archery bow and support an arrow, comprising:

a main housing, said main housing adapted to be mounted to the archery bow;

a support assembly mounted as part of said main housing;

a rest element adapted to support the arrow in a support position, said rest element attached to said support assembly such that said rest element is moved by said support assembly;

a spring biasing said rest element;

a lock assembly attached to said support assembly to lock said rest element in said support position;

a lock to capture said lock assembly and lock said rest element in said support position;

an actuator to engage said lock assembly by dislodging said lock assembly from said lock and allow movement of said rest element to said release position; and a cord attached to said actuator to activate said actuator to dislodge said lock assembly, said cord adapted to be connected to a moving element of the archery bow such that said cord moves when the moving element moves, said cord connected such that when the moving element moves during firing of the arrow, said actuator dislodges said lock assembly from said lock due to release of tension on said cord.

2. The drop away arrow rest of claim 1, wherein said cord is adapted to be connected to movement of a bow string such that said cord moves when the bow string moves, said cord connected such that when the bow string is released during firing of the arrow said actuator engages said lock assembly due to release of tension on said cord.

3. The drop away arrow rest of claim 1, wherein, said main housing includes a component cavity; wherein said support assembly is a rotor rotatably mounted in said component cavity; wherein said rest element is a launcher attached to said rotor such that said launcher rotates with said rotor; wherein said spring biasing said rest element is a rotor spring attached to said rotor; and wherein said lock assembly is attached to said rotor to lock said rotor and said launcher in said support position.

4. The arrow rest of claim 3, wherein during movement the bow string said rotor and said launcher cannot move when said lock assembly is engaged in said lock.

5. The arrow rest of claim 3, wherein said actuator is a distance away from said lock assembly such that a delay between release of the bow string during firing of the arrow and said actuator engaging said lock assembly creates a delay in said launcher moving from said support position to a release position.

6. The arrow rest of claim 3, wherein said rotor has a start position when in a release position that sets the position of said launcher and wherein said start position of said rotor is adjustable to allow adjustment of the position of said launcher.

7. The arrow rest of claim 6, further including an end cap that mounts to said main housing; wherein said rotor includes a guide pin; wherein said end cap includes a guide pin groove to receive said guide pin of said rotor, said guide pin groove including an end point that sets said start position of said rotor.

8. The arrow rest of claim 6, further including a bumper in guide point groove at said end point to absorb shock when said rotor moves from said support position to said release position.

9. The arrow rest of claim 3, further including a bumper in said main housing to absorb shock when said rotor moves from said support position to a release position.

10. The arrow rest of claim 3, wherein said lock assembly includes lock body and a lock spring; said lock body mounted to said rotor such that said lock body is locked in rotation with said rotor, yet said lock body is movable toward and away from said rotor where said lock body is mounted to said rotor; and said lock spring mounted to said lock body to bias said lock body from said rotor and towards said lock.

11. The arrow rest of claim 10, wherein said lock body includes at least one roller axle and roller combination; and wherein said main housing includes at least one roller path to said lock such that each of said roller is caught by each of said lock to lock said rotor in said support position; and wherein said lock spring biases said roller into said lock due to said lock body being biased away from said rotor.

12. The arrow rest of claim 10, wherein said actuator includes an actuator body and an actuator head; wherein said lock body includes a actuator channel to receive said actuator body, said actuator body being able to travel along said actuator channel; and wherein said actuator head is attached to said actuator body such that said actuator head can strike said lock body.

13. The arrow rest of claim 12, further including a actuator spring in said actuator channel which biases said actuator towards said lock assembly so that said actuator travels toward said lock assembly under a force from said actuator spring when tension is released on said cord to allow said actuator head to strike said lock body.

14. The arrow rest of claim 12, wherein said actuator body includes a travel length that said actuator head can be pulled away from said lock body by said cord and wherein said travel length provides a delay before said lock assembly is released from said lock.

15. The arrow rest of claim 3, wherein said lock assembly includes at least one roller axle and roller combination; and wherein said main housing includes at least one roller path to said lock such that each of said roller is caught by each of said lock to lock said rotor in said support position.

16. The arrow rest of claim 3, wherein said actuator is mounted to said lock assembly; further including a actuator spring which biases said actuator towards said lock assembly so that said actuator travels toward said lock assembly under a force from said actuator spring when tension is released on said cord.

17. The arrow rest of claim 1, wherein said actuator is a distance away from said lock assembly such that a delay between release of the bow string during firing of the arrow and said actuator hitting said lock assembly creates a delay in said rest element moving from said support position to said release position.

18. The arrow rest of claim 1, wherein said actuator is mounted to said lock assembly; further including a actuator spring which biases said actuator towards said lock assembly so that said actuator travels toward said lock assembly under a force from said actuator spring when tension is released on said cord.

19. The arrow rest of claim 18, wherein said actuator includes a actuator body and actuator head; wherein said lock body includes a actuator channel to receive said actuator body, said actuator body being able to travel along said actuator channel; and wherein said actuator head is attached to said actuator body such that said actuator head can strike said lock body.

20. The arrow rest of claim 19, further including a actuator spring in said actuator channel which biases said actuator towards said lock assembly so that said actuator travels toward said lock assembly under a force from said actuator spring when tension is released on said cord to allow said actuator head to strike said lock body.

21. An arrow rest comprising:

a body having a mounting facility adapted to mount to an archery bow having a bow string;

a rotor rotatably mounted to the body and defining a rotor axis;

the rotor including a rest element;

the rotor being movable between a support position in which the rest element is elevated and a launch position in which the rest element is depressed;

a rotor spring operable to bias the rotor to the launch position;

a detent facility operably connecting the rotor and the body;

the detent facility including a detent spring biasing a detent element to a stable position to restrain the rotor in the support position while the detent element is in the stable position;

a release facility connected to the rotor and having a hammer operable to reciprocate between a retracted position and a released position;

a cord connected to the hammer and having a free end adapted for connection to the bow string;

a hammer spring connected to the hammer and operable to bias the hammer toward the detent element;

the hammer being responsive to tension on the cord to move to the retracted position;

the hammer being responsive to release of tension on the cord to strike the detent facility and dislodge the detent element from the stable position, such that the rotor spring moves the rotor to the released position.

22. The arrow rest of claim 21 wherein the detent spring and hammer spring are compression coil springs.

23. The arrow rest of claim 21 wherein the detent spring and hammer spring are coaxial about a common axis.

24. The arrow rest of claim 23 wherein the common axis is perpendicular to the rotor axis.

25. The arrow rest of claim 21 wherein the detent element includes a sleeve defining a detent bore and wherein a portion of the hammer element is received within the bore.

26. The arrow rest of claim 25 wherein the cord extends through the detent bore.

27. The arrow rest of claim 25 wherein the hammer defines a hammer bore and wherein the cord extends through the hammer bore.

28. The arrow rest of claim 21 wherein the detent spring biases the detent in a first direction and the hammer spring biases the hammer in an opposed second direction.

29. The arrow rest of claim 21 wherein the body defines a body bore receiving the rotor.

30. The arrow rest of claim 21 wherein the body bore defines a detent receptacle adapted to receive a portion of the detent element in the stable position.

31. The arrow rest of claim 21 wherein the rotor defines a rotor bore receiving the detent element.

32. The arrow rest of claim 31 wherein the rotor bore is perpendicular to the rotor axis.

33. The arrow rest of claim 21 wherein the rest element is an elongated body extending away from the rotor axis and including a support element adapted to support an arrow and movable between a plurality of positions along the length of the rest element.

34. The arrow rest of claim 21 wherein the both includes a housing portion receiving the rotor and wherein the housing portion defined a slot concentric with the rotor axis and reviewing the cord.

35. The arrow rest of claim 21 wherein the detent spring has force greater than a selected threshold such that movement of the hammer to the released position at a limited velocity does not dislodge the detent facility from the stable position.

36. An arrow rest comprising:

a body having a mounting facility adapted to mount to an archery bow having a bow string;

a rotor rotatably mounted to the body and defining a rotor axis;

the rotor including a rest element;

the rotor being movable between a support position in which the rest element is elevated and a launch position in which the rest element is depressed;

a first spring operable to bias the rotor to the launch position;

a detent facility operably connecting the rotor and the body;

a cord connected having a first end connected to the rotor by way of an extension facility and the cord having a free end adapted for connection to the bow string;

the extension facility being movable with respect to the rotor to pay out and retract the cord with respect to the rotor.

37. The arrow rest of claim 36 wherein the extension facility reciprocates along an extension axis with respect to the rotor.

38. The arrow rest of claim 37 wherein the extension axis is perpendicular to the rotor axis.

39. The arrow rest of claim 37 wherein the extension axis intersects the rotor axis.

40. The arrow rest of claim 36 including a second spring adapted to bias the extension facility with respect to the rotor, and a third spring adapted to bias the cord with respect to the extension facility.

* * * * *